US006361212B1

(12) United States Patent
Sprehe et al.

(10) Patent No.: US 6,361,212 B1
(45) Date of Patent: Mar. 26, 2002

(54) TOP OPENING RECLOSABLE BAG AND METHOD OF MANUFACTURE THEREOF

(75) Inventors: Gregory S. Sprehe, Carbondale; Donald K. Wright, Murphysboro; Christopher L. Pemberton, Marion, all of IL (US)

(73) Assignee: Com-Pac International, Inc., Carbondale, IL (US)

( * ) Notice: Subject to any disclaimer, the term of this patent is extended or adjusted under 35 U.S.C. 154(b) by 0 days.

(21) Appl. No.: 09/420,184

(22) Filed: Oct. 18, 1999

(51) Int. Cl.[7] ..... B65D 33/16

(52) U.S. Cl. ..... 383/63; 383/61; 383/65; 383/204

(58) Field of Search ..... 383/61, 63, 203, 383/204, 65, 66

(56) References Cited

U.S. PATENT DOCUMENTS

| | | | | |
|---|---|---|---|---|
| 4,246,288 A | * | 1/1981 | Sanborn, Jr. | 426/122 |
| 4,335,817 A | | 6/1982 | Bahr | |
| 4,617,683 A | | 10/1986 | Christoff | |
| 4,655,862 A | | 4/1987 | Christoff, et al. | |
| 4,709,398 A | | 11/1987 | Ausnit | |
| 4,759,642 A | * | 7/1988 | Van Erden et al. | 383/63 |
| 4,844,759 A | | 7/1989 | Boeckmann | |
| 4,878,987 A | | 11/1989 | Ven Erden | |
| 4,909,017 A | | 3/1990 | McMahon et al. | |
| 5,024,537 A | | 6/1991 | Tilman | |
| 5,111,643 A | | 5/1992 | Hobock | |
| 5,461,845 A | | 10/1995 | Yeager | |
| 5,525,363 A | | 6/1996 | Herber et al. | |
| 5,557,907 A | | 9/1996 | Malin et al. | |
| 5,564,259 A | | 10/1996 | Stolmeier | |
| 5,592,802 A | | 1/1997 | Malin et al. | |
| 5,601,368 A | * | 2/1997 | Bodolay et al. | 383/61 X |
| 5,776,045 A | | 7/1998 | Bodolay et al. | |
| 5,782,733 A | | 7/1998 | Yeager | |
| 5,816,018 A | | 10/1998 | Bois | |
| 5,829,884 A | * | 11/1998 | Yeager | 383/61 |
| 5,951,453 A | | 9/1999 | Yeager | |
| 5,972,396 A | * | 10/1999 | Jurgovan et al. | 383/61 X |
| 6,000,197 A | | 12/1999 | Ausnit | |
| 6,007,246 A | * | 12/1999 | Kinigakis et al. | 383/63 X |
| 6,030,122 A | * | 2/2000 | Ramsey et al. | 383/61 |
| 6,044,621 A | * | 4/2000 | Malin et al. | 53/412 |
| 6,088,998 A | * | 7/2000 | Malin et al. | 53/416 |

FOREIGN PATENT DOCUMENTS

| | | | | |
|---|---|---|---|---|
| EP | 0 792 802 A1 | | 9/1997 | |
| JP | 5-270551 | * | 10/1993 | 383/63 |
| WO | WO 98/03328 | | 1/1998 | |

* cited by examiner

*Primary Examiner*—Jes F. Pascua
(74) *Attorney, Agent, or Firm*—Michael Best & Friedrich

(57) ABSTRACT

The present invention includes a reclosable back-seam bag and method for making the bag. The reclosable back-seam bag includes a bag body having a top seal and a bottom seal, and a front wall and a back wall. The front wall is joined to the back wall at the top seal and the bottom seal. A reclosable fastener assembly including two ends, a first continuous elongated profile strip and a second continuous elongated profile strip is included in the bag. The first continuous elongated profile and the second continuous elongated profile provide an airtight and watertight seal upon interconnection thereof. An airtight and/or watertight side seal at each end of the reclosable fastener assembly is also provided. A continuous airtight and watertight lower seal along the length of the reclosable fastener assembly is positioned below the profiles. The lower seal connects the reclosable fastener assembly to the front wall. A continuous airtight and watertight upper seal along the length of the reclosable fastener assembly is positioned above the profiles. The upper seal connects the reclosable fastener to the back wall.

20 Claims, 4 Drawing Sheets

TOP OPENING RECLOSABLE BAG AND METHOD OF MANUFACTURE THEREOF

BACKGROUND OF THE INVENTION

This invention generally relates to reclosable plastic bags, and a method of their manufacture that is more efficient and economical than conventional methods and devices.

An illustrative patent is U.S. Pat. No. 5,461,845 to Yeager ("Yeager '845 patent"). There are at least two definitive shortcomings with the technology described therein. The first shortcoming relates to the problem of having to open the zipper completely from the front panel of the finished bag. Users of reclosable bags and packaging are accustomed to opening the profiled fastener from the "top" of the package, and not from the front panel of the package. Hence, the user will have to become accustomed to an unfamiliar or uncomfortable manner in which to open a bag.

The second shortcoming is more serious, and relates to the requirement of opening the package from the front panel thereof. If the package is to be opened from the front panel, a cut or perforation must be made before the fastener is applied. This cut, or perforation, is generally shaped like an "oval" with opening "tabs" for gaining access to the fastener. Since the fastener, most likely, is not closed at the ends of the fastener, the possibility of contamination exists.

The most expedient and economical way to make the package is to create the cut, or perforation, in one operation, just upstream of the fastener strip application. This operation, in its simplest form, will leave openings for potential contamination to pass through the cut or perforated front panel opening. To overcome this contamination potential, users of this method add a great deal more cost and complexity to create a sealed, sealable "patch", or some other means of eliminating this contamination risk. The same problem occurs, if the package must be hermetically sealed.

Another example of the prior art includes U.S. Pat. No. 4,909,017 to McMahon ("McMahon '017 patent"). A particular problem with the McMahon '017 technique is that one obtains a naturally curled thin strip fastener that ultimately makes the fastener unstable, and irregularly shaped. In addition to the problem of sealing the backside of this unstable, irregular-shaped strip fastener to the bag wall(s), there is the problem of keeping the material from naturally curling after sealing the strip to a bag wall, making it even more difficult to get a uniform seal on the backside of the fastener strip.

Hence, there exists a need to solve the problems in the art that are articulated above.

SUMMARY OF THE INVENTION

Accordingly, it is an object of the invention to overcome the shortcomings of the prior art by providing a reclosable back-seam bag that provides a hermetic seal by sealing a bag body with a top seal, a bottom seal, a back seam seal, and a plurality of seals sealing a reclosable fastener with flanges to a front wall and a back wall of the bag body.

It is a further object of the invention to provide a reclosable bag having a reclosable fastener assembly that includes two ends, a first continuous elongated profile strip and a second continuous elongated profile strip. The first continuous elongated profile and the second continuous elongated profile provides an airtight and/or watertight seal upon interconnection thereof.

It is yet a further object of the invention to provide an airtight and/or watertight side seal at each end of the reclosable fastener assembly. Each of the side seals connects an end of the reclosable fastener assembly to an inside surface of the front wall and an inside surface of the back wall of the bag.

It is another object of the invention to provide a continuous airtight and watertight lower seal along the length of the reclosable fastener assembly positioned below the profiles. The lower seal connects the reclosable fastener assembly to the front wall. Yet another continuous airtight and watertight upper seal is provided along the length of the reclosable fastener assembly and positioned above the profiles. The upper seal connects the reclosable fastener assembly to the back wall of the bag body.

Another object of the invention is to provide a bag with a first continuous elongated profile strip that has a front wall connecting flange and a gripping flange. Both the front wall connecting flange and the gripping flange have a width greater than a width of the first continuous elongated profile strip to assist in positioning and sealing of the reclosable fastener to web stock. The front wall-connecting flange is sealed to the front wall of the bag.

The invention further provides a bag with a second continuous elongated profile strip that has a back wall-connecting flange. The back wall connecting flange has a width greater than a width of the second continuous elongated profile strip so that the back wall connecting flange can be easily sealed to the back wall. The length of the reclosable fastener assembly is less than the width of the back wall of the bag to provide ease of sealing of the side seals of the bag.

It is a further object of the invention to provide a frangible access that is substantially parallel to the reclosable fastener assembly. Upon opening, the frangible access exposes the reclosable fastener assembly. The frangible access is located on the front wall and on the back wall of the bag body adjacent the reclosable fastener assembly and above the upper seal.

It is yet another object of the invention to provide a reclosable back-seam bag in which the first continuous elongated profile strip and the second continuous elongated profile strip each have respective back portions. The back portions can move in relation to the inside surface of the rectangular sheet and thus provide the bag with greater flexibility and tear resistance.

It is a further object of the invention to provide a reclosable back-seam bag having a gripping flange that includes a continuous rib located at a distal end of the gripping flange and/or a plurality of continuous, substantially parallel ribs located on the gripping flange. The ribs and the gripping flange provide a user with ease of opening of the reclosable fastener once the frangible access has been opened.

Yet another object of the invention is to provide a method of making a reclosable back-seam bag. The method includes the steps of providing a rectangular sheet of polymeric material having an inside surface. A predetermined length of a reclosable fastener including two ends, and a first continuous elongated profile strip interlocked with a second continuous elongated profile strip is provided, and a front wall connecting flange of the reclosable fastener is connected to the inside surface of the rectangular sheet.

The method includes the step of forming a bag body having a front wall and a back wall. The back wall is formed by folding the rectangular sheet of film along two longitudinal folds, and overlapping and sealing edges of the rectangular sheet.

The method further includes joining the front wall to the back wall at a bottom seal, and connecting a back wall connecting flange to the inside surface of the rectangular sheet and the back wall of the bag at a back wall connecting seal. Each end of the reclosable fastener is sealed to the inside surface of the rectangular sheet of film inwardly of the longitudinal folds of the bag body thereby preventing air or liquids from entering or leaving the bag through the ends of the reclosable fastener. A frangible access substantially parallel to the reclosable fastener being located on the front wall and on the back wall of the bag body adjacent the reclosable fastener and above the back wall connecting seal is provided for exposing the reclosable fastener. The method also includes providing a top seal above the frangible access.

Yet another object of the invention is to provide a method of making a reclosable bag that includes splotching and substantially flattening the ends of the reclosable fastener prior to the step of connecting the front wall connecting flange to the inside surface of the rectangular sheet. In a variant of the invention it is also appreciated that the ends can be flattened by compression molding the ends into the desired shape with or without the use of heat or ultrasonic sealing. Further the flattened ends and/or the bag body can have marks or other machine readable indicia thereon to permit an electric eye or the like to read the marks or indicia and achieve proper registration and alignment of the reclosable fastener with the bag body.

It is yet another object of the present invention to allow the customer/user of the package to open the package from the top, as he or she is accustomed.

It is another object of this invention to overcome the shortcomings of the art by using flanged reclosable fasteners in the bag forming process, and requiring that the operations for making the bag involve sealing two flat, substantially parallel thin surfaces. There is no irregular surface that is sealed to attach the fastener to the front panel, or to carry the fastener through the bagger and down the form, fill and seal tube, or to seal the back-seamed side of the package.

It is an additional object of the invention to have the flanges of the reclosable fastener sized and dimensioned to prevent the flanges from being sealed to the wrong bag wall as described below.

It is a further object of the invention to provide an automatic contamination-free package by sealing the fastener completely inside the package, and providing a hermetically sealed space within the bag body with an airtight and watertight reclosable fastener seal and other bag body seals. In this variant, the package is opened at the perforations of the package to allow the customer/user to get to the gripping flange of the fastener.

It is another object of the present invention to solve these and other problems in the art, and to serve a market that demands hundreds of millions of reclosable plastic bags annually. The objects and features of the present invention, other than those specifically set forth above, will become apparent in the detailed description of the invention set forth below and in the drawings.

DETAILED DESCRIPTION OF THE INVENTION

Figure 1:
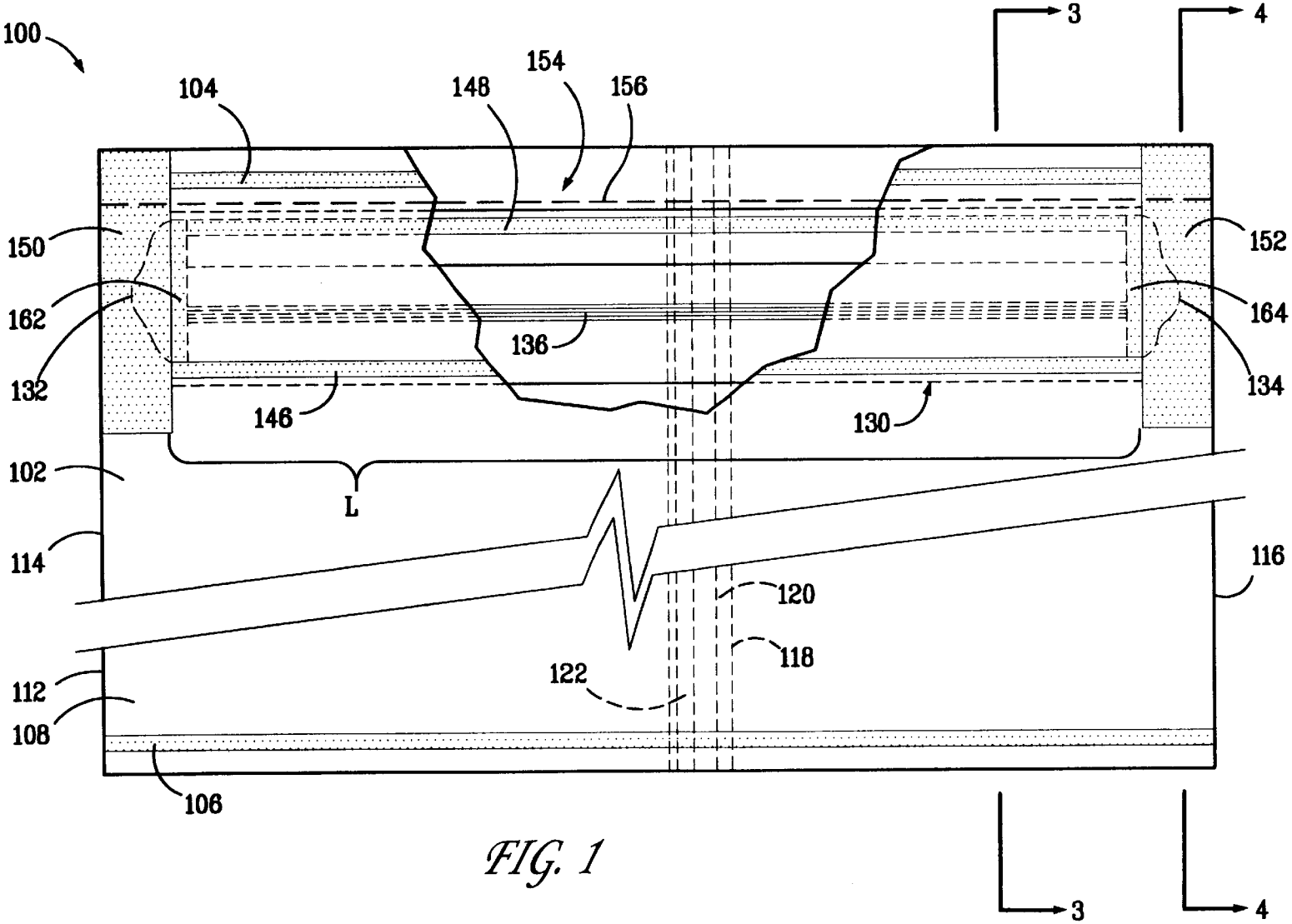
FIG. 1 is a front plan view of a reclosable bag of the present invention.

FIG. 1 is a front plan view of reclosable back-seam bag 100. Bag 100 includes a bag body 102. Bag body 102 (FIGS. 1–4) has a top seal 104 and a bottom seal 106, and a front wall 108 and a back wall 110. Front wall 108 (FIGS. 1, 3 and 4) is joined to the back wall 110 at the top seal 104 and the bottom seal 106 (FIGS. 1–4). It is appreciated that bag body 102 can be formed on conventional form fill and seal machines known in the art.

Figure 2:
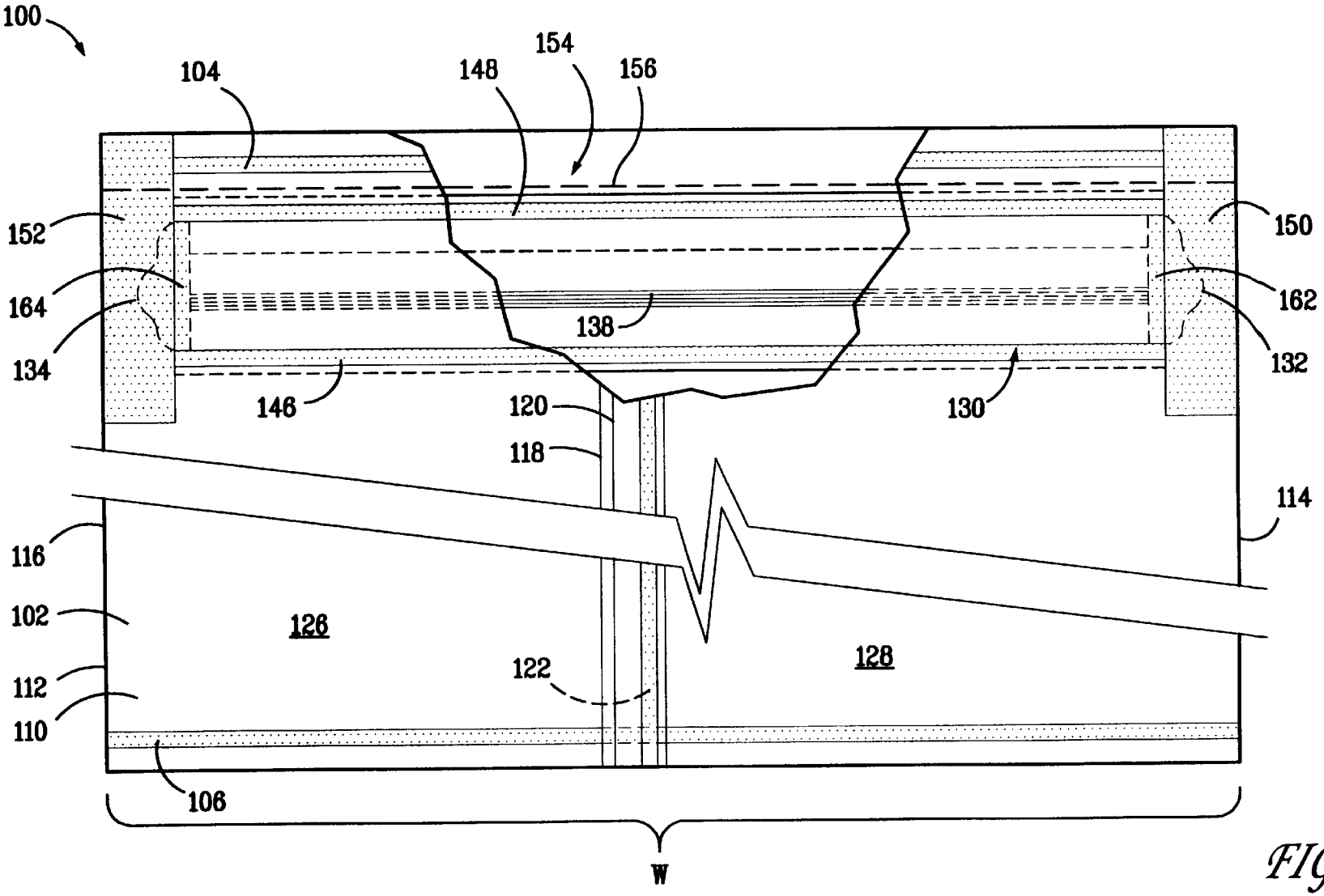
FIG. 2 is a back plan view of the bag of FIG. 1.
Figure 3:
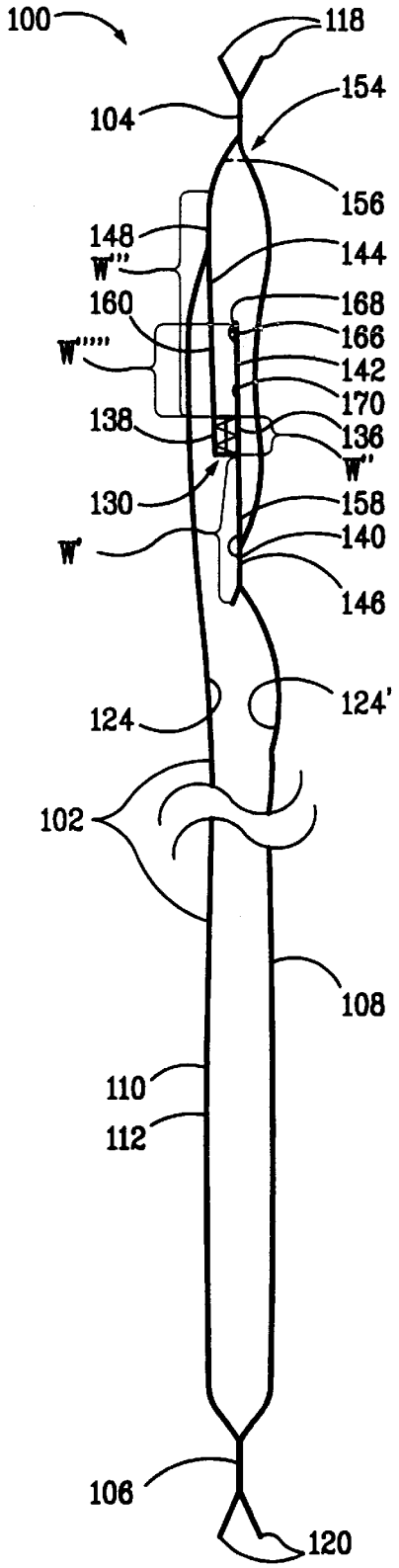
FIG. 3 is a side cross sectional view of the bag of FIG. 1.

Bag 100 includes reclosable fastener assembly 130 (FIGS. 1–3). Reclosable fastener assembly 130 includes two ends 132, 134. Between ends 132, 134, a first continuous elongated profile strip 136 is releasably interlocked with a second continuous elongated profile strip 138. It is appreciated that first continuous elongated profile 136 and the second continuous elongated profile 138 have protruding male and female members (not shown) which when interlocked provide an airtight and watertight seal. Many types of male and female members are known in the art and can be used in the present invention.

At each end 132, 134 of the reclosable fastener assembly 130 is an airtight and/or watertight side seal 150, 152 (FIGS. 1–3). Each side seal 150, 152 connects an end of the reclosable fastener assembly 130 to an inside surface 124 of front wall 108 and an inside surface 124 of back wall 110 (FIG. 3). Any of the seals described herein can be made by a variety of devices including heat sealers, ultrasonic sealers, and other devices known in the art. The seals also may be made with an adhesive.

Figure 5:
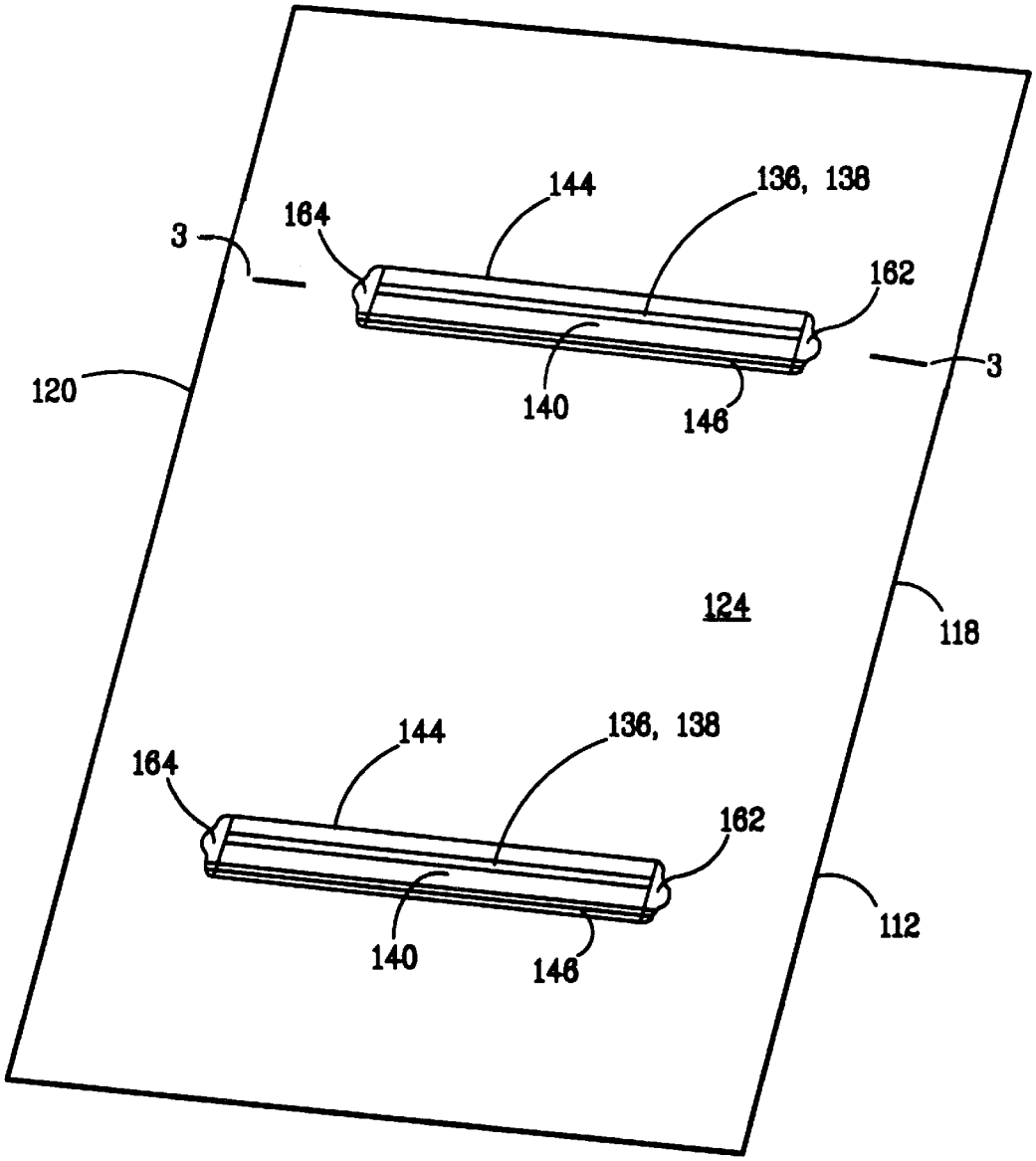

A continuous airtight and/or watertight lower seal 146 is disposed along the length L of the reclosable fastener assembly 130 and is positioned below the profile strips 136, 138. It is appreciated that seal 146 is placed such that seal 146 connects the reclosable fastener assembly 130 to the front wall 108 prior to rectangular sheet of film 112 being formed into a tubular structure precursor of bag body 102. That is, seal 146 preferably connects reclosable fastener assembly 130 to rectangular sheet of film 112 while the sheet of film is still in a substantially flat state (FIG. 5).

A continuous airtight and/or watertight upper seal 148 along the length L of the reclosable fastener assembly is positioned above the profile strips 136, 138. The upper seal 148 connects the reclosable fastener to back wall 110. Preferably, upper seal 148 is made after the bag body 102 is substantially complete, e.g. after the bag body 102 has been substantially completed on a form fill and seal machine. This is accomplished by sealing jaws on the form fill and seal machine.

In a preferred embodiment, reclosable back-seam bag 100 includes a first continuous elongated profile strip 136 that has a front wall connecting flange 140 and a gripping flange 142 (FIG. 3). Both the front wall connecting flange 140 and the gripping flange 142 having widths W', W '"" greater than a width W" of the first continuous elongated profile strip 136. It is appreciated that by providing flanges 140, 144, the problems associated with sealing an irregularly shaped surface, e.g. a zipper profile, to a smooth surface are eliminated. The flange 140 and flange 144 provide a substantially smooth, planar and uniform surface to which to seal the inside surface 124 of rectangular sheet of film 112 thereto.

By way of example, front wall connecting flange 140 is sealed to front wall 108 at inside surface 124'. Similarly, second continuous elongated profile strip 138 has a back wall-connecting flange 144. The back wall connecting flange 144 has a width W'" greater than a width W" of the second continuous elongated profile strip 138, and in a variant a width greater than gripping flange 142. Back wall connecting flange 140 is sealed to back wall 110 at back wall connecting seal 148.

To improve the appearance and air and watertightness of bag 100 it is preferred that the length L of the reclosable fastener assembly 130 is less than the width W of back wall 110 (FIG. 2).

Figure 4:
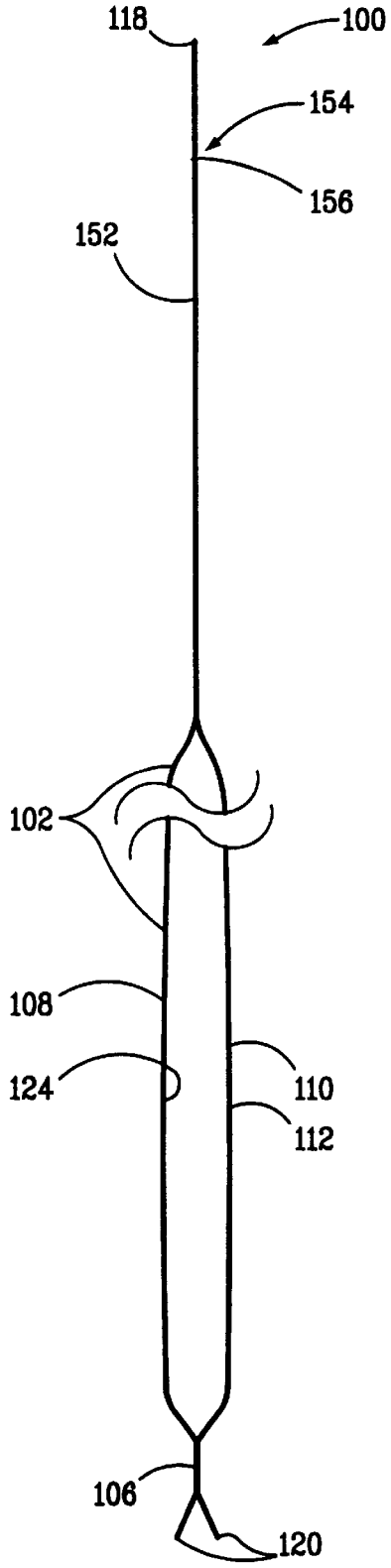
FIG. 4 is a side cross sectional view of the bag of FIG. 1 through a side seal of the bag; and, FIG. 5 is a perspective view of a rectangular sheet of film having a plurality of reclosable fastener assemblies thereon prior to a form, fill and seal operation.

In a variant of the invention, reclosable back seam bag 100 includes a frangible access 154 (FIGS. 1–4). Access 154 can take many forms including a crease line, a score line, or a plurality of perforations. Preferably, access 154 is substantially parallel to the reclosable fastener assembly 130. Removal of access 154 exposes the releasable fastener assembly 130 and provides access to the gripping flange 142, and profile strips 136, 138. One feature of the invention is that frangible access 154 is located both on the front wall 108 and on the back wall 110 of the bag body 102 adjacent the reclosable fastener assembly 130 and above the upper seal 148 (FIGS. 1 and 2). In a preferred embodiment, frangible access 154 comprises a plurality of perforations 156 (FIGS. 1, 3 and 4).

Back wall 110 of bag body 102 is formed from rectangular sheet of film 112 (FIG. 5) on a conventional form, fill and seal machine. Preferably, the form fill and seal machine is a vertical form, fill and seal machine. Film 112 can be made from any suitable material but is preferably made from a polymeric material. Film 112 is folded along two longitudinal folds 114, 116, as the film passes through the form fill and seal machine. The vertical edges 118, 120 (FIG. 1) are overlapped and sealed as is conventional to form back seam 122. Back wall 110 has two sides 126, 128 (FIG. 2). Each side 126, 128 is defined between back seam 122 and a respective one of the longitudinal folds 114, 116.

Reclosable fastener 130 includes two ends 132, 134, a first continuous elongated profile strip 136 and a second continuous elongated profile strip 138. First continuous elongated profile strip 136 is releasably connected to the second continuous elongated profile strip 138. It is appreciated that profile strips 136, 138 can be of the type conventionally known in the art, including male and female interlocking members. By way of example, strip 136 is matable to strip 138, and either strip 136 or strip 138 can be complementary male and female strips as required.

First continuous elongated profile strip 136 has a front wall connecting flange 140 and a gripping flange 142. Front wall connecting flange 140 is heat sealed or ultrasonically sealed to rectangular sheet of film 112 while film 112 is in a substantially flat state (FIG. 5). The sealing of front wall connecting flange 146 to film 112 occurs prior to the formation of a tube (not shown) from film 112 on a conventional form fill and seal machine. It is further appreciated that strips 136, 138 are interlocked at the time flange 146 is sealed to film 112 (FIG. 5). In particular, front wall connecting flange 146 is connected to the inside surface 124 of the rectangular sheet of film 112 and the front wall 108 of the bag body 102 at a front wall seal 146. Front wall seal 146 is substantially parallel to top seal 104 and spaced between the bottom seal 106 and the profile strips 136, 138.

Both front wall connecting flange 140 and gripping flange 142 have widths W"", W"" greater than a width W" of the first continuous elongated profile strip 136. Second continuous elongated profile strip 138 has a back wall-connecting flange 144. In a preferred embodiment, width W' of gripping flange 142 is about 0.8 centimeters, and width W" of strip 136 is about 0.3 centimeters. Back wall connecting flange 144 has a width W'" greater than a width W" of second continuous elongated profile strip 138. Width W'" of flange 144 is about 1.7centimeters in a preferred embodiment, and W" is about 0.3 centimeters. Gripping flange 142 allows for a user to easily open the interlocked strips 136, 138, by grasping flange 142 and back wall connecting flange 144 and separating the flanges 142, 144. Width W"" of the gripping flange 142 is preferably substantially less than width W'" of the back wall connecting flange 144. It is appreciated that the use of these widths facilitates the placement of back wall connecting seal 148 such that the gripping flange 142 does not interfere with the sealing process.

To aid in the formation of the airtight and/or watertight seals used in the present invention, it is appreciated that the length L of the reclosable fastener 130 is less than the combined lengths of the two sides 126, 128 that form the back panel of bag body 102. In a preferred embodiment, length L is about 21.5 centimeters.

Back wall connecting flange 144 is connected to the inside surface 124 of the rectangular sheet of film 112 and the back wall 110 at a back wall connecting seal 148. Back wall connecting seal 148 is spaced between profile strips 136, 138, and the top seal 104. In a preferred embodiment of bag 100, bag 100 has the various seals placed as follows:

- Top seal 104 is located approximately 3 millimeters from the top of bag 100;
- Frangible access 154 is located about 4 millimeters below top seal 104;
- Back wall connecting seal 148 is located about 5 millimeters below frangible access 154;
- Profiles 136, 138 are located about 1.3 centimeters below back wall connecting seal 148;
- Front wall connecting flange 140 is located about 7 millimeters below profiles 136, 138; and,
- Bottom seal 106 is located about 30 centimeters below front wall connecting flange 140.

Side seals 150, 152 are placed at each end of the reclosable fastener assembly 130. Side seals 150, 152 provide an airtight and/or watertight seal between the inside surface 124 of film 112 and reclosable fastener assembly 130. Each of the side seals 150, 152 connects an end 132, 134 of the reclosable fastener 130 to the inside surfaces 124, 124' of the rectangular sheet of film 112 inwardly of the longitudinal folds 114, 116 of the bag body 102 thereby preventing air or liquids from entering or leaving the bag through the ends 132, 134 of the reclosable fastener assembly 130. Preferably, prior to the sealing of front wall connecting flange 140 to front wall 108, the ends 132, 134 of reclosable fastener 130 are splotched. Splotching of reclosable fastener ends 132, 134 creates substantially flattened ends 162, 164 which facilitate the formation of the airtight and/or watertight seals of the invention.

A frangible access 154 can be cut between back wall connecting seal 148 and top seal 104 with a standard perforating die, and the like, access 154 is substantially parallel to the reclosable fastener 130 and exposes reclosable fastener 130 to a user. Frangible access 154 is located on the front wall 108 and on the back wall 110 of the bag body 102 adjacent reclosable fastener 130 and above back wall connecting seal 148. It is appreciated that upon opening of frangible access 154, both front wall 108 and back wall 110 of bag 100 are severed. In a preferred embodiment, frangible access 154 comprises a plurality of perforations 156.

In a preferred embodiment, first continuous elongated profile strip 136 and the second continuous elongated profile strip 138 each have respective back portions 158, 160 thereof (FIG. 3). By providing the seals 146, 148 as illustrated in the figures, first continuous elongated profile strip back portion 158 can move in relation to the inside surface 124' of the rectangular sheet of film 112. It is further appreciated that the seal placement permits second continuous elongated profile strip back portion 160 to move in relation to the inside surface 124 of the rectangular sheet of film 112.

Preferably, gripping flange 142 includes a continuous rib 166 located at a distal end 168 of the gripping flange 142. Gripping flange 142 can also include a plurality of continuous, substantially parallel ribs 170 located on the gripping flange 142.

It is appreciated that reclosable fastener assembly 130 can take many forms. Preferably, gripping flange 142 and front wall connecting flange 140 are made from a single, extruded, flexible polymeric material. That is, gripping flange 142 and connecting flange 140 and profile strip 136 are extruded and form a continuous member. Similarly, second continuous profile strip 138 and the back wall-connecting flange 144 are formed from an extruded, flexible polymeric material, and are extruded such that they form a single continuous member. It is appreciated that back wall connecting flange 144 and front wall connecting flange 140 are of a sufficient thickness to seal to the respective walls that they connect to, yet of a sufficient thickness not to seal to the inside surface 124 of walls 108, 110 that they are not to seal to when a predetermined amount of heat, pressure and dwell time are applied. A sufficient thickness is empirically determined depending on the type of film 112 used and the type of polymeric material used for profile strips 136, 138, and flanges 140, 144.

In a variant of the invention, gripping flange 142 and the bag wall-connecting flange are made from a single web. First continuous profile strip 136 is sealed to the web with an airtight and/or watertight seal (not shown). Similarly, strip 138 can be sealed to a second web.

A method of making a reclosable back-seam bag 100 is also provided herein. A rectangular sheet of polymeric material 112 having an inside surface 124 is provided in a substantially flat state (FIG. 5). A predetermined length L of a reclosable fastener 130 including two ends 132, 134, a first continuous elongated profile strip 136 and a second continuous elongated profile strip 138 is cut from a longer length (e.g., a continuous roll of interlocked fastener assemblies). First continuous elongated profile strip 136 is releasably connected to second continuous elongated profile strip 138. For each length L of fastener 130, ends 132 and 134 are splotched so that they are substantially flattened.

The reclosable fastener 130 is moved onto film 112 transverse to the length of the film 112 in one variant of the invention, or longitudinally across the length of the film 112 in another variant of the invention. Front wall connecting flange 140 is sealed with an airtight and/or watertight seal to the inside surface 124' of the rectangular sheet of film 112 such that it is approximately centered thereon in relation to the width of the sheet of film 112. Bag body 102 is formed on a conventional form, fill, and seal machine. Bag body 102 is formed into a tube (not shown) such that a front wall 108 and a back wall 110 are formed. Back wall 110 is formed by folding the rectangular sheet of film 112 along two longitudinal folds 114, 116, and overlapping and sealing edges 118, 120 of the rectangular sheet of film 112. Back wall 110 has two sides 126, 128. Each side 126, 128 is defined between back seam 122 and a respective one of the longitudinal folds 114, 116. After the film is formed into a tube (not shown), front wall 108 is joined to the back wall 110 at a bottom seal 106. Bottom seal 106 is made in conventional heat sealing jaws (not shown).

Back wall connecting flange 144 is connected (e.g. by heat sealing) to the inside surface 124 of rectangular sheet 112 at what is now the back wall 110 of bag body 102 at back wall connecting seal 148 The method also includes sealing each end 132, 134 of the reclosable fastener 130 to the inside surfaces 124, 124' of the rectangular sheet of film 112 inwardly of the longitudinal folds 114, 116 of the bag body 102 thereby preventing air or liquids from entering or leaving the bag through the ends 132, 134 of the reclosable fastener 130.

The method further includes providing frangible access 154 substantially parallel to the reclosable fastener 130 for exposing releasable fastener 130. Access 154 is formed with a conventional perforating die, and is located on front wall 108 and on back wall 110 of the bag body 102 adjacent the reclosable fastener assembly 130 and above the back wall connecting seal 148.

The method then includes providing top seal 104 above the frangible access 154. Properly feeding, locating and sealing reclosable fastener 130 at predetermined locations on rectangular sheet of film 112 readily are important aspects of the method (FIG. 5). Rectangular sheet of film 112 has marks 3 or other machine readable indicia thereon to permit an electric eye or other sensor to read the marks or indicia so that proper registration and alignment of the recloseable fastener 130 is obtained with the bag body. Machines commercially available from Z-Patch, Inc. of Carbondale, Ill. are reliable and capable of repeatedly performing the steps referred to in the method described above with high throughput and with low cycle times. The film as shown in FIG. 5 made by the Z-Patch machine is then fed into a form fill seal machine (not shown), having sealing heads adapted to make seals 104, 106, 150, 152, 122, and other seals referred to herein. The manner in which reclosable fastener 130 is fed and positioned for sealing onto rectangular sheet of film 112 is critical in order to achieve repeatability.

Reclosable fastener 130, which is generally about 3.5 centimeters wide, in one variant of the invention, is delivered in a cross web, stretched position, assuring squareness for positioning onto rectangular sheet of film 112. It is appreciated that the width and length of fastener 130 can be such that it accommodates the size of the bag body. The front wall seal 146 is transverse to film 112.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

We claim:

1. A reclosable back-seam bag, comprising:

a bag body having a top seal and a bottom seal, and a front wall and a back wall, said front wall being joined to said back wall at said top seal and said bottom seal, a reclosable fastener assembly including two ends, a first continuous elongated profile strip and a second continuous elongated profile strip, said first continuous elongated profile strip and said second continuous elongated profile strip providing an airtight and watertight seal upon interconnection thereof, an airtight and watertight side seal at each end of said reclosable fastener assembly, each said side seal being provided to said reclosable fastener assembly prior to attachment of said reclosable fastener assembly to said front wall and said back wall, each said side seal being sealed again to connect an end of said reclosable fastener assembly to an inside surface of said front wall and an inside surface of said back wall, a continuous airtight and watertight lower seal along the length of said reclosable fastener assembly positioned below said profile strips, said lower seal connecting said reclosable fastener assembly to said front wall, and, a continuous airtight and watertight upper seal along the length of said reclosable fastener assembly positioned above said profile strips, said upper seal connecting said reclosable fastener to said back wall.

2. The reclosable back-seam bag according to claim 1 in which said first continuous elongated profile strip has a front wall connecting flange and a gripping flange, both said front wall connecting flange and said gripping flange having a width greater than a width of said first continuous elongated profile strip, and said front wall connecting flange being sealed to said front wall.

3. The reclosable back-seam bag according to claim 1 in which said second continuous elongated profile strip has a back wall connecting flange, said back wall connecting flange having a width greater than a width of said second continuous elongated profile strip, and said front wall connecting flange being sealed to said back wall.

4. The reclosable back-seam bag according to claim 1 in which the length of said reclosable fastener assembly is less than the width of said back wall.

5. The reclosable back seam bag according to claim 1 further comprising a frangible access substantially parallel to said reclosable fastener assembly for exposing said releasable fastener assembly, said frangible access being located on said front wall and on said back wall of said bag body adjacent said reclosable fastener assembly and above said upper seal.

6. The reclosable back-seam bag according to claim 5 in which said frangible access comprises a plurality of perforations.

7. A reclosable back-seam bag, comprising:

a bag body having a top seal and a bottom seal, and a front wall and a back wall, the front wall being joined to the back wall at the top seal and the bottom seal, the back wall being formed from a rectangular sheet of film folded along two longitudinal folds, and having overlapped and sealed edges of the rectangular sheet to form said back seam, said rectangular sheet having an inside surface, and said back wall having two sides, each side being defined between said back seam and a respective one of said longitudinal folds;

a reclosable fastener including two ends, a first continuous elongated profile strip and a second continuous elongated profile strip, said first continuous elongated profile strip being releasably connected to said second continuous elongated profile strip, said first continuous elongated profile strip having a front wall connecting flange and a gripping flange, both said front wall connecting flange and said gripping flange having a width greater than a width of said first continuous elongated profile strip, said second continuous elongated profile strip having a back wall connecting flange, said back wall connecting flange having a width greater than a width of said second continuous elongated profile strip, the length of said reclosable fastener being less than the combined lengths of said two sides that form said back panel;

said front wall connecting flange being connected to said inside surface of said rectangular sheet and said front wall of said bag body at a front wall seal, said front wall seal being substantially parallel to said top seal and spaced between said bottom seal and said profile strips, said back wall connecting flange being connected to said inside surface of said rectangular sheet and said back wall at a back wall connecting seal, said back wall connecting seal being spaced between said profile strips and said top seal;

a side seal at each end of said reclosable fastener, each said side seal connecting an end of said reclosable fastener to the inside surface of said rectangular sheet of film inwardly of said longitudinal folds of said bag body thereby preventing air or liquids from entering or leaving said bag through said ends of said reclosable fastener, and each said side seal being provided to said reclosable fastener prior to attachment of said reclosable fastener to said front wall and said back wall, each said side seal being sealed again to connect an end of said reclosable fastener to said inside surface of said front wall and an inside surface of said back wall; and, a frangible access substantially parallel to said reclosable fastener for exposing said releasable fastener, said frangible access being located on said front wall and on said back wall of said bag body adjacent said reclosable fastener and above said back wall connecting seal.

8. The reclosable back-seam bag according to claim 7 in which said frangible access comprises a plurality of perforations.

9. The reclosable back-seam bag according to claim 7 in which said first continuous elongated profile strip and said second continuous elongated profile strip each have respective back portions thereof, and in which said first continuous elongated profile strip back portion can move in relation to said inside surface of said rectangular sheet.

10. The reclosable back-seam bag according to claim 7 in which said first continuous elongated profile strip and said second continuous elongated profile strip each have respective back portions thereof, and in which said second continuous elongated profile strip back portion can move in relation to said inside surface of said rectangular sheet.

11. The reclosable back-seam bag according to claim 7 in which said first continuous elongated profile strip and said second continuous elongated profile strip each have respective back portions thereof, in which said first continuous elongated profile strip back portion can move in relation to said inside surface of said rectangular sheet, and in which said second continuous elongated profile strip back portion can move in relation to said inside surface of said rectangular sheet.

12. The reclosable back-seam bag according to claim 7 in which said reclosable fastener ends are substantially flattened ends.

13. The reclosable back-seam bag according to claim 7 in which said gripping flange includes a continuous rib located at a distal end of said gripping flange.

14. The reclosable back-seam bag according to claim 7 in which said gripping flange includes a plurality of continuous, substantially parallel ribs located on said gripping flange.

15. The reclosable back-seam bag according to claim 7 in which said first continuous profile strip, said gripping flange and said bag wall connecting flange comprise a single, extruded, flexible polymeric material.

16. The reclosable back-seam bag according to claim 7 in which said second continuous profile strip and said back wall connecting flange comprise an extruded, flexible polymeric material.

17. The reclosable back-seam bag according to claim 7 in which said gripping flange and said bag wall connecting flange comprise a web and in which said first continuous profile strip is sealed to said web.

18. The reclosable back-seam bag according to claim 7 in which the width of said gripping flange is substantially less than the width of said back wall connecting flange.

19. The reclosable back-seam bag according to claim 7 in which the width of said gripping flange is substantially less than half the width of said back wall connecting flange.

20. The reclosable back-seam bag according to claim 7 in which said back wall connecting flange is of a sufficient thickness to provide for sealing of said back wall connecting flange to said back wall while not permitting sealing of said back wall connecting flange to said front wall.

* * * * *